US006892683B2

(12) United States Patent
Diehl et al.

(10) Patent No.: US 6,892,683 B2
(45) Date of Patent: May 17, 2005

(54) ELECTROHYDRAULIC VALVE CONTROLLER

(75) Inventors: Udo Diehl, Stuttgart (DE); Uwe Hammer, Hemmingen (DE); Volker Beuche, Stuttgart (DE); Peter Lang, Weissach (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 24 days.

(21) Appl. No.: 10/380,508

(22) PCT Filed: May 18, 2002

(86) PCT No.: PCT/DE02/01806

§ 371 (c)(1),
(2), (4) Date: Aug. 6, 2003

(87) PCT Pub. No.: WO03/008770

PCT Pub. Date: Jan. 30, 2003

(65) Prior Publication Data

US 2004/0035388 A1 Feb. 26, 2004

(30) Foreign Application Priority Data

Jul. 17, 2001 (DE) ..... 101 34 644

(51) Int. Cl.[7] ..... F01L 9/02

(52) U.S. Cl. ..... 123/90.12; 123/90.11; 251/12

(58) Field of Search ..... 123/90.11, 90.12, 123/90.1; 251/12, 14, 129.01, 129.02, 129.15

(56) References Cited

U.S. PATENT DOCUMENTS

| | | | | |
|---|---|---|---|---|
| 4,615,306 A | | 10/1986 | Wakeman et al. | |
| 5,168,840 A | | 12/1992 | Taxon | |
| 5,937,806 A | * | 8/1999 | Lyko et al. | 123/90.15 |
| 6,474,277 B1 | * | 11/2002 | Vanderpoel et al. | 123/90.12 |

FOREIGN PATENT DOCUMENTS

| | | |
|---|---|---|
| DE | 39 11 495 C1 | 8/1990 |
| EP | 0 915 235 A | 5/1999 |
| WO | 9966178 | 12/1999 |
| WO | 01 20139 A | 3/2001 |

* cited by examiner

*Primary Examiner*—Thomas Denion
*Assistant Examiner*—Ching Chang
(74) *Attorney, Agent, or Firm*—Ronald E. Greigg

(57) ABSTRACT

The invention relates to an electrohydraulic valve controller for controlling a gas exchange valve in internal combustion engines, having a hydraulically actuatable control valve including a control valve piston which can be acted upon, via electrically actuatable valves, by a hydraulic medium that is under pressure, and a hydraulically acting valve brake is assigned to the control valve piston. The valve brake (46) includes a temperature compensation for the hydraulic medium.

18 Claims, 2 Drawing Sheets

ELECTROHYDRAULIC VALVE CONTROLLER

CROSS-REFERENCE TO RELATED APPLICATIONS

This application is a 35 USC 371 application of PCT/DE 02/01806 filed on May 18, 2002.

BACKGROUND OF THE INVENTION

1. Field of the Invention

The invention relates to an improved electrohydraulic valve controller, in particular for controlling a gas exchange valve in internal combustion engines.

2. Prior Art

In internal combustion engines used for driving motor vehicles a fuel-air mixture is compressed and ignited in a work chamber where the energy produced is converted into mechanical work. In such engines, the air, or the fuel-air mixture, is delivered to the work chamber via valves (inlet or intake valves) and to remove the products of combustion from the work chamber via valves (outlet or exhaust valves). Controlling these valves is very significant for determining the efficiency of the engine. In particular, the gas exchange in the work chamber is controlled via the control of the valves.

Besides camshaft control, it is also known to use an electrohydraulic valve controller. The electrohydraulic valve controller offers the capability of variable or fully variable valve control, making it possible to optimize the gas exchange and thus to enhance the motor efficiency [redundant, or "engine efficiency"] of the engine.

The electrohydraulic valve controller includes a hydraulically actuatable control valve, whose control valve piston actuates a valve body of the inlet and outlet valves and leads toward a valve seat (valve seat ring) (closure of the valve) or moves away from it (opening of the valve). The control valve can be actuated by way of controlling the pressure of a hydraulic medium. The pressure control is effected here via magnet valves incorporated into the hydraulic circuit. To achieve gas exchanges that are as optimal as possible, the highest possible switching speeds of the control valve are needed. As a result of these high switching speeds, the valve body of the inlet and outlet valves strikes the valve seat ring at high speed. The result is on the one hand noise, and on the other the valve components are subject to relatively high wear.

In order to reduce the switching speed of the control valve shortly before the valve body strikes the valve seat ring, it is known to assign a hydraulically acting valve brake to the control valve piston. This valve brake is based on reducing a flow cross section for the hydraulic medium, so that a damping action ensues. A disadvantage, however, is that the braking action of the valve brake is very highly dependent on the viscosity of the hydraulic medium, which as a rule is hydraulic oil. The viscosity of the hydraulic medium is in turn highly temperature-dependent. As a result, the valve action of the valve brake and thus the impact speed of the valve body on the valve seat ring is highly temperature-dependent.

SUMMARY OF THE INVENTION

The electrohydraulic valve controller of the invention, conversely, offers the advantage that the impact speed of the valve body of the gas exchange valve on the valve seat can be reduced to a predeterminable constant value, virtually independently of any viscosity of the hydraulic medium. Because the valve brake includes a temperature compensation for the hydraulic medium, it is advantageously possible to compensate for fluctuating braking actions of the valve brake that are caused by temperature-dictated changes in viscosity. As a result, the impact speed of the valve body of the gas exchange valve can be set to a predeterminable value independently of any fluctuations in temperature. In particular, an automatic mechanical temperature compensation is possible as a result.

In a preferred feature of the invention, it is provided that the valve brake includes a first hydraulic circuit, forming a brake circuit, and a second hydraulic circuit, forming a compensation circuit; a hydraulic medium with essentially the same temperature is used in the brake circuit and in the compensation circuit. As a result, the temperature compensation is possible in an especially simple way, since if changes in temperature of the hydraulic medium occur in the brake circuit, the hydraulic medium in the compensation circuit undergoes the same change in temperature. Changes in viscosity caused by the temperature changes can thus be taken into account directly in the brake circuit, so that the braking action of the valve brake remains constant even if the temperatures fluctuate.

BRIEF DESCRIPTION OF THE DRAWINGS

The invention will be explained in further detail below in conjunction with the associated drawings in which.

DESCRIPTION OF THE PREFERRED EMBODIMENTS

Figure 1:
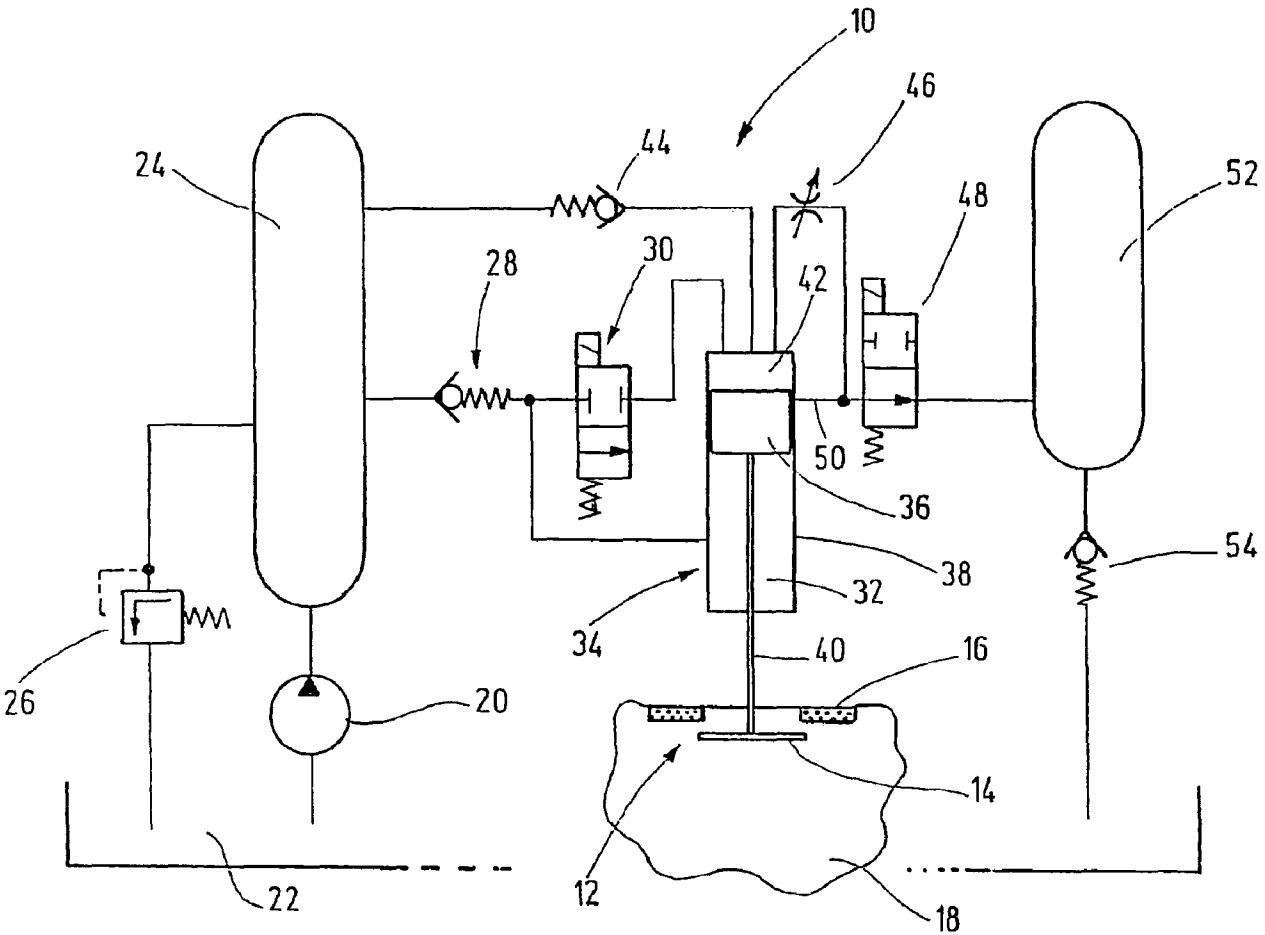
FIG. 1. is a hydraulic circuit diagram of an electrohydraulic valve controller embodying the invention.

FIG. 1 shows a circuit diagram of an electrohydraulic valve controller 10 for controlling a gas exchange valve 12. The gas exchange valve 12 includes a valve body 14, with which a valve seat embodied as a valve seat ring 16 is associated. The valve seat ring 16 is disposed in a cylinder head 18, shown here only in suggested form, of an internal combustion engine. The structure and mode of operation of such gas exchange valves 12 are well known and therefore need not be addressed in detail in the context of the present description.

The valve controller 10 includes a hydraulic pumping device 20, by means of which a hydraulic medium—hereinafter called hydraulic oil—can be pumped out of an oil sump 22 into a high-pressure reservoir 24. The high-pressure reservoir 24 communicates with the oil sump 22 via a pressure limiting valve 26, so that a defined oil pressure can be built up in the high-pressure reservoir 24.

The high-pressure reservoir 24 moreover communicates via a check valve 28 with a bistable magnet valve 30 and a first pressure chamber 32 of a control valve 34. The control valve 34 has a control valve piston 36, which is guided tightly inside a cylinder 38. Via an actuating means 40, the control valve piston 36 is operatively connected to the valve body 14 of the gas exchange valve 12.

The control valve piston 36 separates the first pressure chamber 32 of the control valve 34 from a second pressure chamber 42. The second pressure chamber 42 communicates with the magnet valve 30 and, via a check valve 44, with the high-pressure reservoir 24. The second pressure chamber 42 also communicates via a hydraulic valve brake 46 with a second bistable magnet valve 48. A conduit 50 also discharges into the cylinder 38 of the control valve 34 and communicates on its other end with the magnet valve 48. The magnet valve 48 also communicates with a low-pressure reservoir 52, which is in communication with the oil sump 22 via a check valve 54.

The valve controller 10 shown in FIG. 1 has the following function:

By means of the valve controller 10, the gas exchange valve 12 can either be opened (not shown in FIG. 1) or closed. Via the hydraulic pumping device 20, a predeterminable pressure of the hydraulic oil is built up in the high-pressure reservoir 24. By adjustment of the pressure limiting valve 26, the level of this pressure can be determined. If an operating pressure that can be set by the check valve 28 is exceeded, the check valve 28 opens, and so hydraulic oil at this operating pressure is present in the pressure chamber 32 of the control valve 34. For opening the gas exchange valve 12, the magnet valves 30 and 48 are triggered in such a way that the magnet valve 30 is open, and the magnet valve 48 is closed. With the magnet valve 30 open, the operating pressure of the hydraulic oil also prevails in the pressure chamber 42. Thus the same operating pressure prevails in both pressure chambers 32 and 42. However, since the area of the control valve piston 36 acted upon by pressure in the pressure chamber 42 is greater than in the pressure chamber 32, the control valve piston 36 is positively displaced in the direction of the pressure chamber 32. As a result, the gas exchange valve 12 opens. The difference in surface area of the faces acted upon by pressure of the control valve piston 36 toward the pressure chamber 42 and toward the pressure chamber 32 is the result of the cross-sectional area of the actuating means 40 in the pressure chamber 32.

Since the magnet valve 48 is closed, there is no communication with the low-pressure reservoir 52. By the adjusting motion of the control valve piston 36, the conduit 50 is opened toward the pressure chamber 42, so that the valve brake 46 is idle and does not develop any action.

If the gas exchange valve 12 is to be closed, the magnet valves 30 and 48 are switched over; that is, the magnet valve 30 is closed, and the magnet valve 48 is open (as shown for these valves in FIG. 1).

With the magnet valve 30 closed, the operating pressure of the hydraulic oil prevails solely in the pressure chamber 32. As a result, the control valve piston 36 is positively displaced in the direction of the pressure chamber 42, until the valve body 14 of the gas exchange valve 12 strikes the valve seat ring 16. During this adjusting motion of the control valve piston 36, the conduit 50 is initially still open, so that the hydraulic oil located in the pressure chamber 42 is positively displaced into the low-pressure reservoir 52. As soon as the upper control edge of the control valve piston 36 reaches the conduit 50, this conduit is closed, so that the hydraulic oil from the pressure chamber 42 is positively displaced into the low-pressure reservoir 52 via the valve brake 46 and the magnet valve 48. Thus by means of the valve brake 46, just before the closing position of the gas exchange valve 12 is reached, a braking action ensues, so that the impact speed of the valve body 14 on the valve seat ring 16 is reduced.

Figure 2:
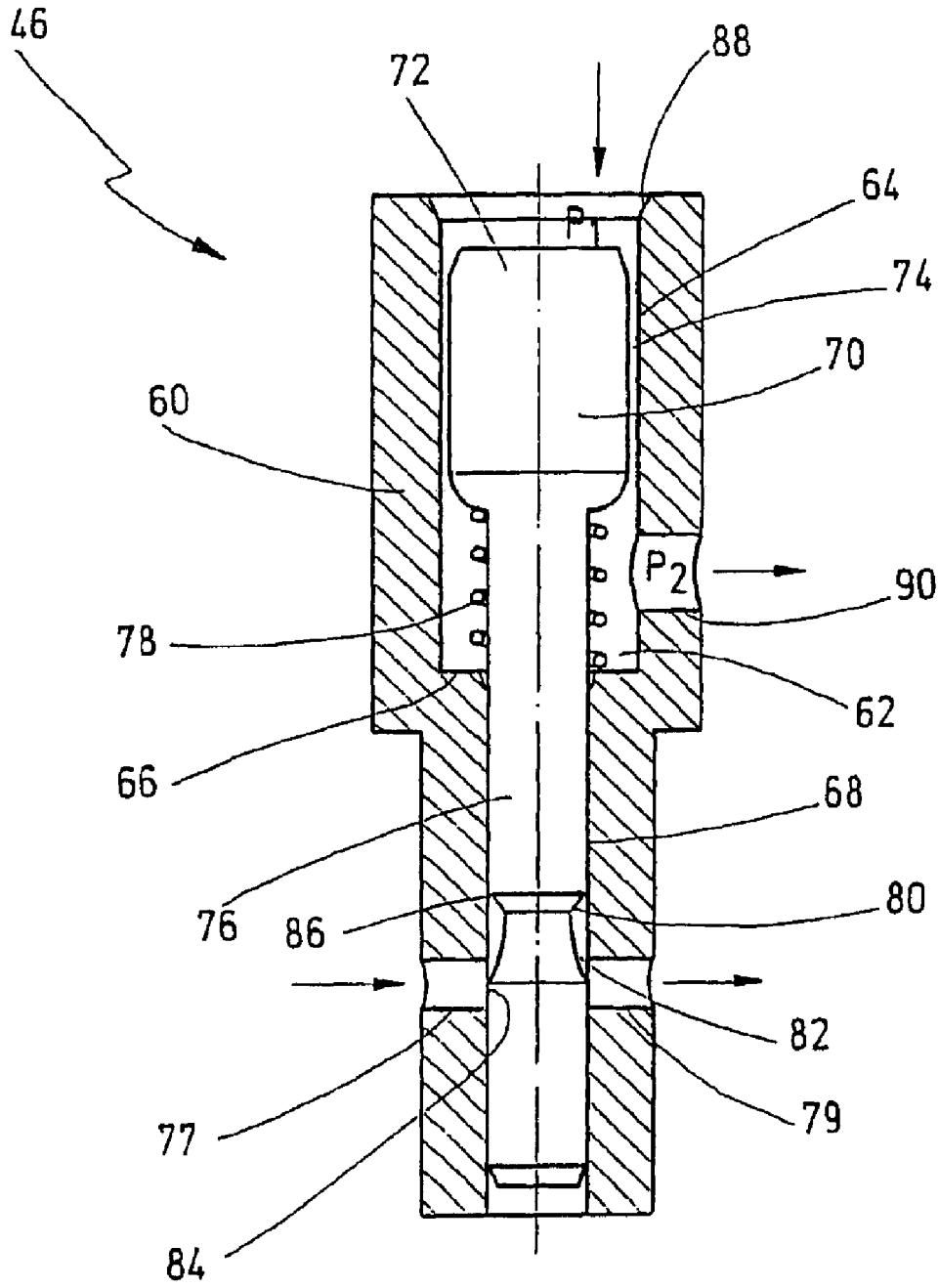
FIG. 2 is a sectional view through a valve brake.

The structure and mode of operation of the valve brake 46 will now be described in further detail in terms of the sectional view in FIG. 2.

The valve brake 46 has a valve housing 60, which forms an internal chamber 62. The internal chamber 62 changes over from a larger-diameter portion 64 to a smaller-diameter portion 68 at an annular step 66. A valve piston 70 is guided in the internal chamber 62. The valve piston 70 has a piston or shoulder 72, which has a smaller diameter than the portion 64 of the internal chamber 62. As a result, between the shoulder 72 and the valve housing 60, an annular gap 74 is formed, with a medium gap diameter dm that is the result of the difference between the diameter of the internal chamber 62 in the portion 64 and the diameter of the shoulder 72.

An extension 76 that engages the portion 68 of the internal chamber 62 extends from the shoulder 72. The extension 76 has a diameter that is equivalent to the diameter of the internal chamber 62 in the portion 68. As a result, the extension 76 is guided sealingly in the portion 68. A spring element 78 is braced on the annular step 66 and on the other end is supported on the shoulder 72.

A first conduit 77 and a second conduit 79 discharge into the internal chamber 62 in the portion 68. The conduit 77 is in communication with the pressure chamber 42 of the control valve 34, and the conduit 79 is in communication with the magnet valve 48 (FIG. 1). In the region of the conduits 77 and 79, the extension 76 has formed therein an annular groove 80, and a bottom 82 of the annular groove 80 extends from a first control edge 84 to a second control edge 86. The geometry of the bottom 82 is selected such that the conical tapering is only simplified, and the geometry of the bottom must be designed, as a function of the pressure difference $p_1-p_2$, the spring rate, and the viscosity behavior of the oil, such that the pressure drop in the brake circuit is always the same.

The conduit 77, annular groove 80, and conduit 79 form one brake circuit of the valve brake 46. If the valve body 14 is to be braked and thus the control valve piston 36 is also to be braked, the hydraulic oil is present at the valve brake 46 via the conduit 77. Depending on the position of the valve piston 70, a throttle gap develops between the control edge 84 and the conduits 77 and 79, respectively, by way of which gap the hydraulic oil reaches the annular groove 80. The geometry of the annular groove 80 is designed such that the pressure in the pressure chamber 42 has no influence on the throttle gap and thus on the braking action (pressure compensation).

A further conduit 88 and a conduit 90 discharge into the internal chamber 62 in the region of the portion 64 of the internal chamber 62. The conduit 90 discharges into the internal chamber 62 at an axial length from the conduit 88 that is greater than an axial length of the shoulder 72. As a result, the conduits 88 and 90 are in fluidic communication with one another via the annular gap 74. The conduit 88, annular gap 74 and conduit 90 form a compensation circuit of the valve brake 46. The conduit 90 communicates with the oil sump, so that in it a constant pressure $p_2$ is established. The compensation circuit is hydraulically disconnected from the brake circuit of the valve brake 46. By suitable structural or other additional provisions that are not shown in detail, it is assured that the hydraulic oil in the compensation circuit has essentially the same temperature as the hydraulic oil in the brake circuit of the valve brake 46.

The following relationships apply to the compensation circuit. Friction in the annular gap 74 causes a pressure loss $\Delta p$, so that at the conduit 88, the hydraulic oil of the compensation circuit is at a pressure $p_1$; the applicable equation is:

$$\Delta p=p_1-p_2.$$

A volumetric flow $\dot{V}$ in the compensation circuit results in accordance with the following equation:

$$\dot{V} = \frac{\Delta p \cdot s \cdot \pi \cdot dm}{12 \cdot \eta \cdot l},$$

in which s is the gap height, dm is the medium gap diameter, and l is the gap length of the annular gap 74. The character η stands for the dynamic viscosity of the hydraulic oil in the compensation circuit. If all the factors that are dependent on the geometry of the annular gap 74 are combined into a geometry constant C, then the following equation applies:

$$C = \frac{s \cdot dm \cdot \pi}{12 \cdot l}.$$

The result for the pressure loss is accordingly:

$$\Delta p = \frac{\dot{V} \cdot \eta}{C}.$$

Because of the pressures $p_1$ and $p_2$ and the force of the spring element 78, the following force equilibrium ensues at the valve piston 70:

$$p_1 \cdot A1 = p_2 \cdot A2 + F,$$

in which F is the spring force of the spring element 78, and A1 and A2 are the areas, acted upon by pressure, of the shoulder 72 of the valve piston 70. If this formula is solved for F, and if $$p_1 = \Delta p + p_2$$

and if $$\Delta p = \frac{\dot{V} \cdot \eta}{C},$$

the result is $$F = p_2 \cdot (A1 - A2) + \frac{\dot{V} \cdot \eta}{C} \cdot A2 = R \cdot h,$$

in which R is the spring rate and h is the spring height. For the spring height h, the result is accordingly:

$$h = \frac{p_2 \cdot (A1 - A2) + \frac{\dot{V} \cdot \eta}{C} \cdot A2}{R}.$$

From this equation it becomes clear that the height h of the spring element 78 and thus the location of the valve piston 70 are directly dependent on the dynamic viscosity η of the hydraulic oil. If the dynamic viscosity η of the hydraulic oil changes, for instance because of a temperature change, then the location of the valve piston 70 changes automatically. The result is a compensation for a temperature-dependent change in viscosity of the hydraulic oil.

If the annular gap 74 of the spring element 78 and the annular groove 80 are suitably designed, it is accordingly possible to keep the impact speed of the valve body 14 on the valve seat ring 16 constant, independently of the instantaneous viscosity of the hydraulic oil.

The foregoing relates to preferred exemplary embodiments in the invention, it being understood that other variants and embodiments thereof are possible within the spirit and scope of the invention, the latter being defined by the appended claims.

What is claimed is:

1. An electrohydraulic valve controller for controlling the speed with which a gas exchange valve in an internal combustion engines closes, the controller comprising a hydraulically actuatable control valve including a control valve piston which can be acted upon by a hydraulic medium that is under pressure, electrically actuatable valves controlling the flow of hydraulic medium to the control valve piston, a hydraulically acting valve brake assigned to the control valve piston, and a hydraulic fluid temperature compensation circuit in the valve brake (46), wherein the valve brake (46) comprises a first hydraulic circuit, forming a brake circuit, and a second hydraulic circuit, forming a compensation circuit.

2. The electrohydraulic valve controller of claim 1, wherein a hydraulic medium with essentially the same temperature is used in the brake circuit and in the compensation circuit.

3. The electrohydraulic valve controller of claim 2, wherein the valve brake (46) comprises a piston (70) guided in an internal chamber (62) of a housing (60), and wherein the piston (70) hydraulically separates the brake circuit from the compensation circuit.

4. The electrohydraulic valve controller of claim 3, wherein a hydraulic medium at a pressure ($p_1$) is applied to the third conduit (88), and a constant pressure ($p_2$) is applied to the fourth conduit (90), and wherein a volumetric flow of the hydraulic medium via the annular gap (74) is constant.

5. The electrohydraulic valve controller of claim 2, wherein the brake circuit comprises a first conduit (77) of the housing (60), by an annular groove (80) of the piston (70), and by a second conduit (79) of the housing (60).

6. The electrohydraulic valve controller of claim 5, wherein the annular groove (80) comprises a control edge (84), which with a bottom (82) of the annular groove (80) forms a throttle gap of the brake circuit.

7. The electrohydraulic valve controller of claim 1, wherein the valve brake (46) comprises a piston (70) guided in an internal chamber (62) of a housing (60), and wherein the piston (70) hydraulically separates the brake circuit from the compensation circuit.

8. The electrohydraulic valve controller of claim 7, wherein the brake circuit comprises a first conduit (77) of the housing (60), by an annular groove (80) of the piston (70), and by a second conduit (79) of the housing (60).

9. The electrohydraulic valve controller of claim 8, wherein the annular groove (80) comprises a control edge (84), which with a bottom (82) of the annular groove (80) forms a throttle gap of the brake circuit.

10. The electrohydraulic valve controller of claim 7, comprising a spring element (78) engaging the piston (70), and wherein the piston (70) can be shifted in the internal chamber (62) counter to the force of the spring element (78).

11. The electrohydraulic valve controller of claim 1, wherein the temperature compensation functions automatically mechanically.

12. An electrohydraulic valve controller for controlling the speed with which a gas exchange valve in an internal combustion engine closes, the controller comprising a hydraulically actuatable control valve including a control valve piston which can be acted upon by a hydraulic medium that is under pressure, electrically actuatable valves controlling the flow of hydraulic medium to the control valve piston, a hydraulically acting valve brake assigned to the control valve piston, and a hydraulic fluid temperature compensation circuit in the valve brake (46), wherein the valve brake (46) comprises a first hydraulic circuit, forming a brake circuit, and a second hydraulic circuit, forming a compensation circuit, wherein the brake circuit comprises a first conduit (77) of the housing (60), by an annular groove (80) of the piston (70), and by a second conduit (79) of the housing (60).

13. The electrohydraulic valve controller of claim 12, wherein the annular groove (80) comprises a control edge (84), which with a bottom (82) of the annular groove (80) forms a throttle gap of the brake circuit.

14. The electrohydraulic valve controller of claim 13, comprising a spring element (78) engaging the piston (70), and wherein the piston (70) can be shifted in the internal chamber (62) counter to the force of the spring element (78).

15. The electrohydraulic valve controller of claim 13, wherein that the compensation circuit is formed by a third conduit (88) of the housing (60), by an annular gap (74) between the piston (70) of the housing (60), and by a fourth conduit (90) of the housing (60).

16. The electrohydraulic valve controller of claim 12, comprising a spring element (78) engaging the piston (70), and wherein the piston (70) can be shifted in the internal chamber (62) counter to the force of the spring element (78).

17. The electrohydraulic valve controller of claim 12, wherein that the compensation circuit is formed by a third conduit (88) of the housing (60), by an annular gap (74) between the piston (70) of the housing (60), and by a fourth conduit (90) of the housing (60).

18. The electrohydraulic valve controller of claim 17, wherein that the compensation circuit is formed by a third conduit (88) of the housing (60), by an annular gap (74) between the piston (70) of the housing (60), and by a fourth conduit (90) of the housing (60).

* * * * *